United States Patent [19]

Boschi

[11] 4,031,804

[45] June 28, 1977

[54] ROTARY SHOT SHELL RELOADER

[75] Inventor: Richard C. Boschi, Euclid, Ohio

[73] Assignee: Pacific Gunsight Company, Grand Island, Nebr.

[22] Filed: June 16, 1975

[21] Appl. No.: 586,962

[52] U.S. Cl. ..... 86/23; 86/27; 86/29

[51] Int. Cl.[2] ..... F42B 33/00

[58] Field of Search ..... 86/23, 27, 29

[56] References Cited

UNITED STATES PATENTS

| | | | |
|---|---|---|---|
| 3,058,387 | 10/1962 | Hoyer | 86/27 |
| 3,157,086 | 11/1964 | Bachhuber | 86/27 |
| 3,771,411 | 11/1973 | Hazel | 86/27 |

*Primary Examiner*—Edward A. Miller
*Attorney, Agent, or Firm*—David A. Burge Co.

[57] ABSTRACT

A shot shell reloader of the type including a rotatable support for sequentially positioning a plurality of shot shells in each of a series of operating stations is provided with a mechanism for automatically rotating the support to reposition the shot shells in subsequent operating stations at the completion of each reloading step or operation. The mechanism includes a cam and a cam follower which operate a ratchet pawl that engages the rotatable shot shell support.

10 Claims, 6 Drawing Figures

ROTARY SHOT SHELL RELOADER

BACKGROUND OF THE INVENTION

1. Field of the Invention

The present invention relates to shot shell reloaders and more particularly to a plural function shot shell reloader which moves shot shells automatically between operating stations.

2. Prior Art

Shot shell reloaders are known which position a plurality of shot shells sequentially in a plurality of operating stations where different reloading operations are carried out simultaneously on separate shot shells. As shotshells are operated on sequentially at the operating stations their spent primers are removed; new primers are installed; powder, wads, and shot charges are introduced; and the reloaded shells are closed.

Many reloaders have a rotatable support which simultaneously positions a plurality of shot shell open-end-up in different operating stations. At each operating station, an appropriately configured tool is positioned above the shot shell support. Reloading operations are effected by relatively moving the support and the tools toward each other to bring the tools into operating engagement with the shot shells.

A manually operated lever or power drive system is ordinarily provided to effect relative movement of the tools and the support. Where a lever is used, the lever is typically pivoted forwardly toward an operator to move the support upwardly toward the tools, and is pivoted rearwardly away from the operator to move the shot shell support downwardly away from the tools.

One drawback of such reloader apparatus has been that between reloading steps or operations, the shot shell support must be manually rotated to position its shot shells at subsequent operating stations. The time and effort involved in manually rotating the support between each reloading operation is quite significant where a substantial number of shot shells are being reloaded. A reloader of the type described which requires manual rotation of the shot shell support is sold by Pacific Tool Company, Division of Hornady Manufacturing Company, Grand Island, Nebr. under the designation "DL-366."

While some shot shell reloaders have been provided with mechanisms for rotating their shot shell supports, such mechanisms have typically included gear drives and/or other components which are complex and expensive to fabricate. Such mechanisms are typically located inside a shot shell support housing at a position which is inconvenient to reach if the mechanism requires service or lubrication.

At least one proposal has been made to provide a shot shell reloader with a support rotating mechanism which drivingly engages the shot shells rather than the support. Such a mechanism is undesirable not only because it fails to rotate the support properly if the support is not fully loaded with shot shells, but also because the mechanism can damage the shot shells if the reloader jams and the operator applies excessive force to the operatinng lever.

SUMMARY OF THE INVENTION

The present invention overcomes the foregoing and other drrawbacks of the prior art and provides a novel and improved shot shell reloader apparatus.

In accordance with one feature of the present invention, a short shell reloader is provided with a cam and cam follower drive mechanism which drivingly connects with the shotshell support for automatically rotating the shot shell support at the completion of each reloading step or operation to position supported shot shells at subsequent operating stations. The cam and cam follower drive mechanism can, in one form, be provided as a kit to convert existing shot shell reloaders having manually rotatable shot shell supports to reloaders having automatically rotating shot shell supports. In a preferred form, the invention includes a novel and improved shot shell reloader apparatus which incorporates the cam and cam follower drive mechanism.

Shot shell reloaders of the type to which the present invention pertains preferably include a base structure, an elevatable carriage supported on the base structure, and a positioning mechanism for raising and lowering the carriage. A plurality of tools are supported above the carriage and define a plurality of operating stations spaced circumferentially about an imaginary circle having a substantially vertical axis. A shot shell support is mounted on the carriage for rotation about such axis. A plurality of formations are provided in the support. Each formation is adapted to receive a separate shot shell and to position such received shot shells simultaneously in different ones of the operating stations.

An improved drive mechanism embodying the present invention is provided on such a reloader to rotate the shot shell support to position shot shells received in such support formations sequentially in each of the operating stations. The drive mechanism preferably includes first and second cam means respectively defining a curvilinear cam surface and a cam follower engageable with the cam surface. One of these cam means is supported on an arm which is privotally mounted on the elevatable carriage for movement about such axis between first and second positions. The other of the cam means is supported on the base structure. A biasing means is operably connected to the arm and biases the cam follower and the cam surface relatively toward engagement with each other.

The first and second cam means and the biasing means are operable in response to raising of the carriage by the positioning mechanism to pivot the arm in a forward direction about such axis from the first position to the second position. The first and second cam means and the biasing means are also operable in response to lowering of the carriage by the positioning mechanism to pivot the arm in a reverse direction about such axis from the second position to the first position.

A pawl is carried by the arm and is operable to drivingly engage the rotatable shot shell support when the arm is pivoted in a selected one of the forward and reverse directions to rotate the support and to move such received shot shells between adjacent operating stations.

One advantage of such a drive mechanism is its simplicity. There are essentially only two moving parts, namely the arm which pivots relative to the elevatable carriage, and the pawl which is movably supported on the arm. The cam follower is preferably a simple mechanism which is releasably secured to the base structure by set screws.

A further advantage of such a drive mechanism is that it directly engages the rotatable shot shell support rather than the shot shells themselves. By this arrangement, the drive mechanism will rotate the support regardless of whether the support is fully loaded with shot shells, and will not damage the shot shells.

Still another advantage of such a drive mechanism is that the cam surface and cam follower are readily accessible for servicing and lubrication.

As will be apparent from the foregoing summary, it is a general object of the present invention to provide a novel and improved shotshell reloader.

It is another object to provide a novel and improved apparatus which can be added to existing shot shell reloaders to improve their operation.

Other objects and a fuller understanding of the invention may be had by referring to the following description and claims taken in conjunction with the accompanying drawings.

DESCRIPTION OF THE PREFERRED EMBODIMENT

Figure 1:
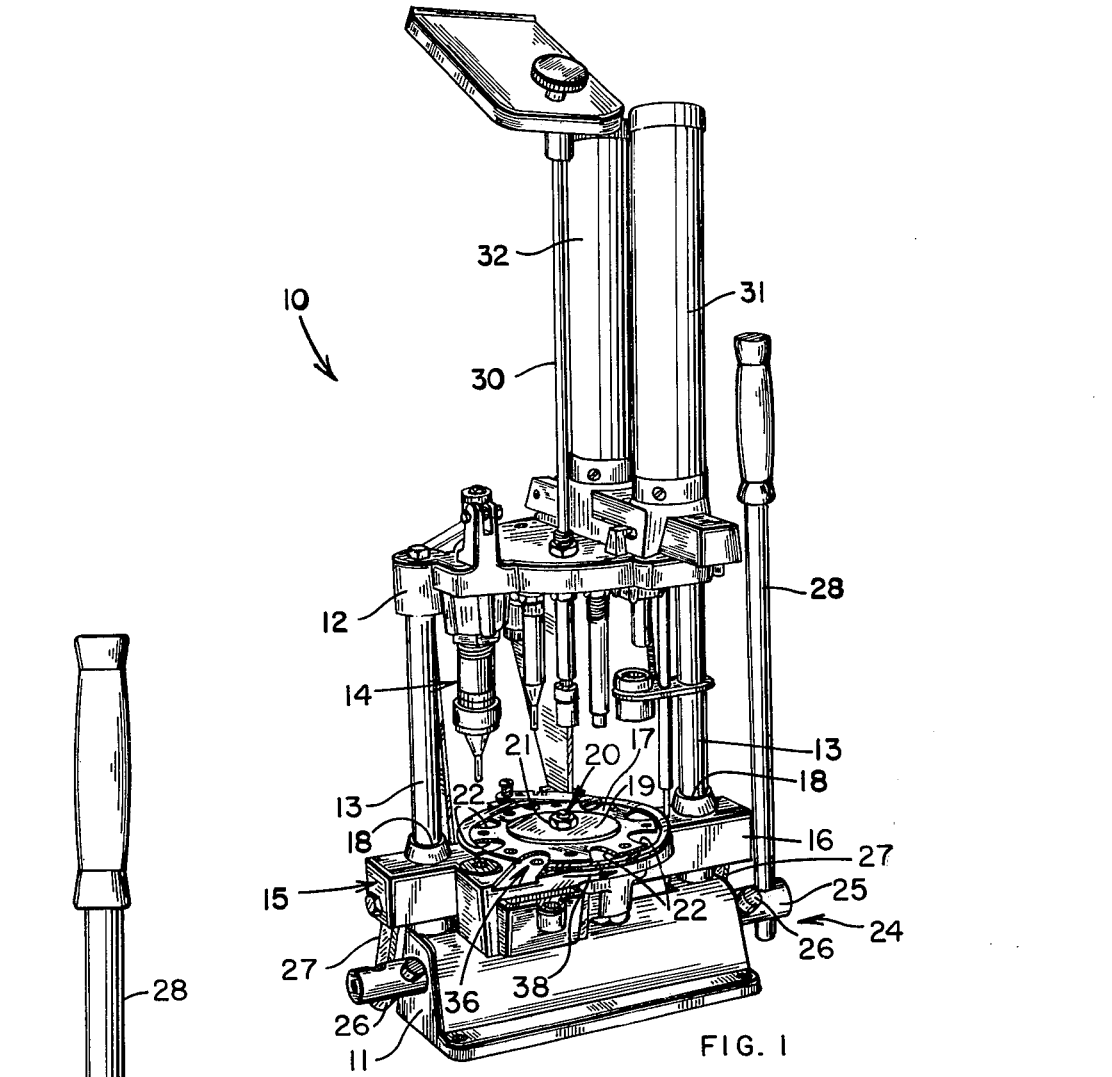
FIG. 1 is a perspective view of a shot shell reloader embodying certain aspects of the present invention, the reloader carriage being shown in its fully lowered position.
Figure 2:
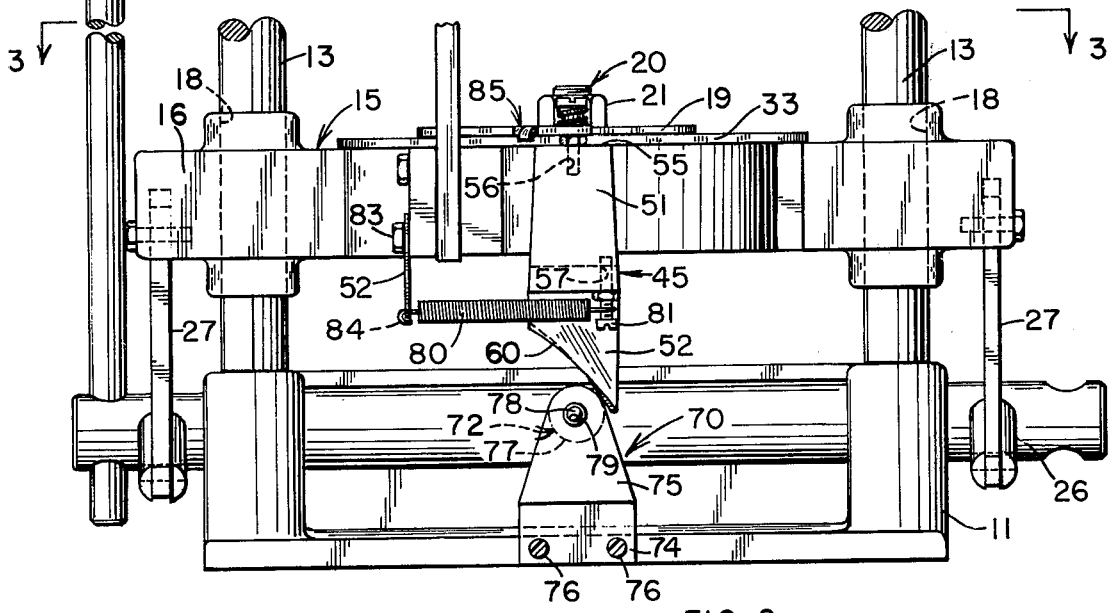
FIG. 2 is an enlarged rear elevational view of a portion of the reloader of FIG. 1, the reloader carriage being shown in an elevated position.

Referring to FIGS. 1–4, a shot shell reloader is indicated generally by the numeral 10. The reloader 10 includes a base structure 11, a tool platform 12, and a pair of spaced upstanding rods 13 which rigidly interconnect the base structure 11 and the tool platform 12. A plurality of tools, indicated generally by the numeral 14, depending from the tool platform and define a series of eight operating stations. The operating stations are spaced equally, circumferentially about an imaginary circle having an axis centered between and paralleling the axes of the rods 13.

A carriage assembly, indicated generally by the numeral 15, is movably supported on the rods 13. The carriage assembly 15 includes a mounting member 16 which underlies and supports a rotatable shot shell support disc 17. A pair of holes 18 are formed through the mounting member 16 to slidably receive the rods 13.

The shot shell support disc 17 is mounted for rotation to position shot shells in operating stations beneath the tools 14. A washer 19 is positioned centrally atop the support disc 17. A threaded fastener 20 extends through a hole in the washer 19 and through an aligned hole in the support disc 17 to mount the support disc 17 on the mounting member 16 for rotation about the axis of the imaginary circle about which the tools 14 are circumferentially spaced. A nut 21 is threaded onto the fastener 20 to limit relative vertical movement between the support disc 17 and the mounting member 16.

Eight radially inwardly extending notches 22 are formed in the support disc 17. The notches 22 are equally circumferentially spaced about the disc 17 and are each sized to receive and support the brass casing of a shot shell.

A carriage positioning mechanism, indicated generally by the numeral 24, is interposed between the base structure 11 and the carriage assembly 15 to move the carriage assembly 15 along the rods 13 toward and away from the tools 14. The positioning mechanism 24 includes a shaft 25 which is journaled by the base structure 11. A pair of arms 26 extend radially from the shaft 25 near opposite ends of the shaft 25. A pair of links 27 pivotally connect with the arms 26 and with the carriage mounting member 16.

A handle 28 extends radially upwardly from one end region of the shaft 25. When the handle 28 is pulled forwardly and downwardly to rotate the shaft 25 in one direction, the arms 26 rotate upwardly and the links 27 cause corresponding upward movement of the carriage assembly 15 toward the tools 14. When the handle 28 is returned to the position shown in FIG. 1, the carriage assembly 15 moves downwardly away from the tools 14.

Positioned atop the tool platform 12 are three dispenser tubes 30, 31, 32. The dispenser tube 30 dispenses new primers to one of the tools 14 for insertion into shot shells. The dispenser tube 31 dispenses powder to another of the tools 14 for insertion into shot shells. The dispenser tube 32 dispenses shot to still another one of the tools 14 for insertion into shot shells.

Figure 3:
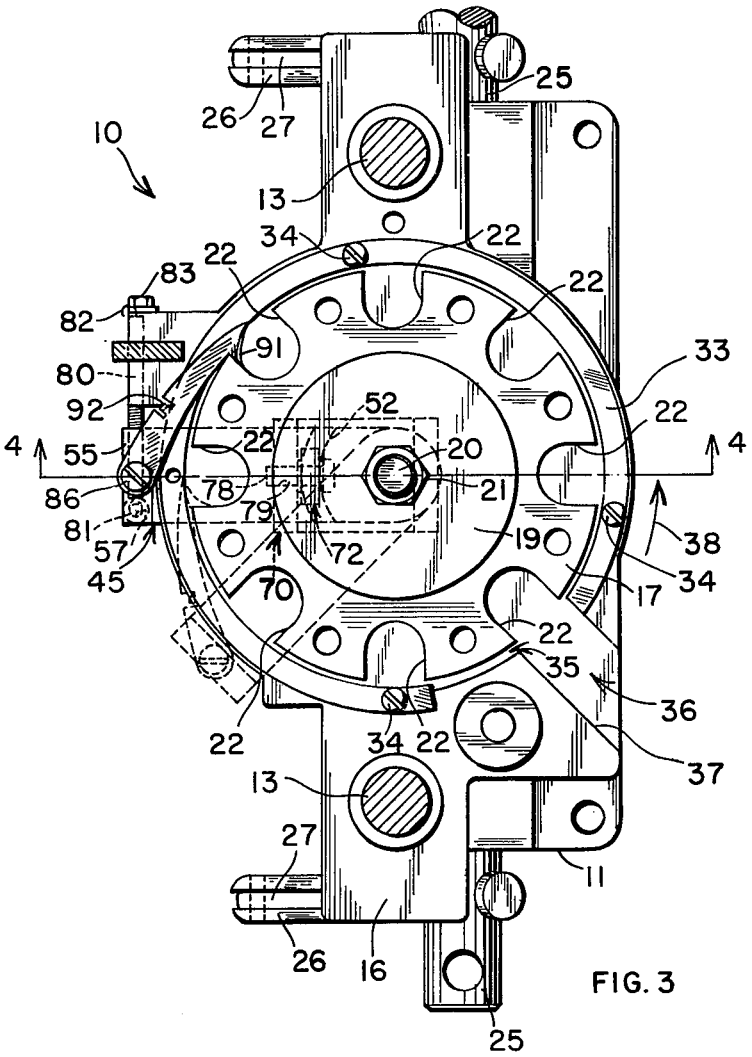
FIG. 3 is a cross-sectional view as seen from a plane indicated by a line 3—3 in FIG. 2.

Referring to FIG. 3, a ring segment 33 extends circumferentially around most of the periphery of the support disc 17. Threaded fasteners 34 extend through holes in the ring segment 33 and secure the ring segment to the mounting member 16. A space 35 is provided between the periphery of the support disc 17 and the inner surface of the ring segment 33.

A loading station is defined by the mounting member 16, as indicated in FIG. 3 by the numeral 36. A recess 37 is formed in the mounting member 16 for moving a shot shell into one of the notches 22.

The shot shell reloader apparatus as described thus far is commercially available from Pacific Tool Company, Division of Hornady Manufacturing Company, Grand Island, Nebr. 68801 under the designation "DL-366." In operation, shot shells are loaded one at a time from the loading station 36 into the notches 22 as each of the notches aligns sequentially with the recess 37. After a shot shell has been inserted in one of the notches 22 at the loading station 36, the handle 28 is pivoted to raise the carriage assembly 15 to bring shot shells on the carriage assembly into operating engagement with one of the tools 14. The handle 28 is then returned to lower the carriage assembly 15, where after the support disc 17 is rotated, as indicated by an arrow 38, to position the shot shells sequentially in each of the seven subsequent operating stations. While the shot shells are in each of the eight operating stations, the handle 28 is pivoted to raise the carriage assembly 15 to bring the shot shells into operating engagement with selected ones of the tools 14. When each shot shell has completed the eight-station sequence, it is reloaded and ready for reuse.

The present invention provides a simple and relatively inexpensive means for automatically rotating the support disc 17 to position shot shells sequentially in each of the described operating stations. In accordance with the preferred practice of the present invention, a cam and cam follower mechanism is interposed between the base structure 11 and the carriage assembly 15 to ratchetingly rotate the support disc 17 at the completion of each reloading step or operation.

Figure 4:
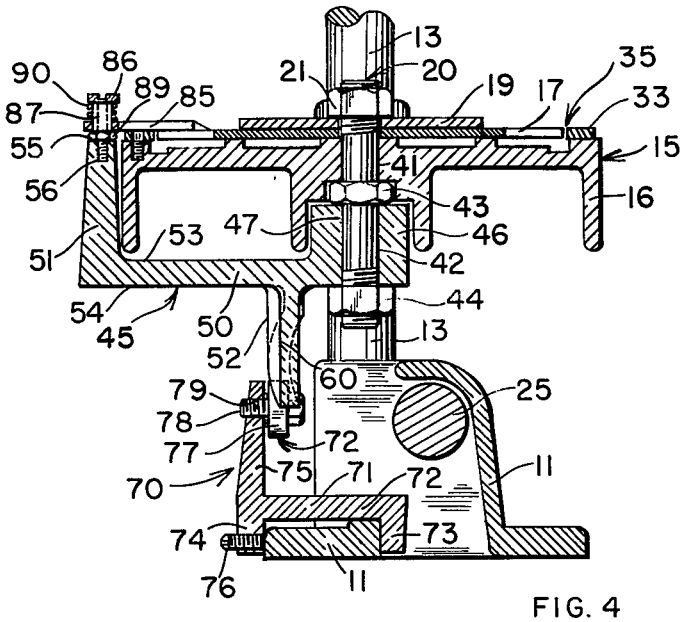
FIG. 4 is a cross-sectional view as seen from a plane indicated by a line 4—4 in FIG. 3.
Figure 5:
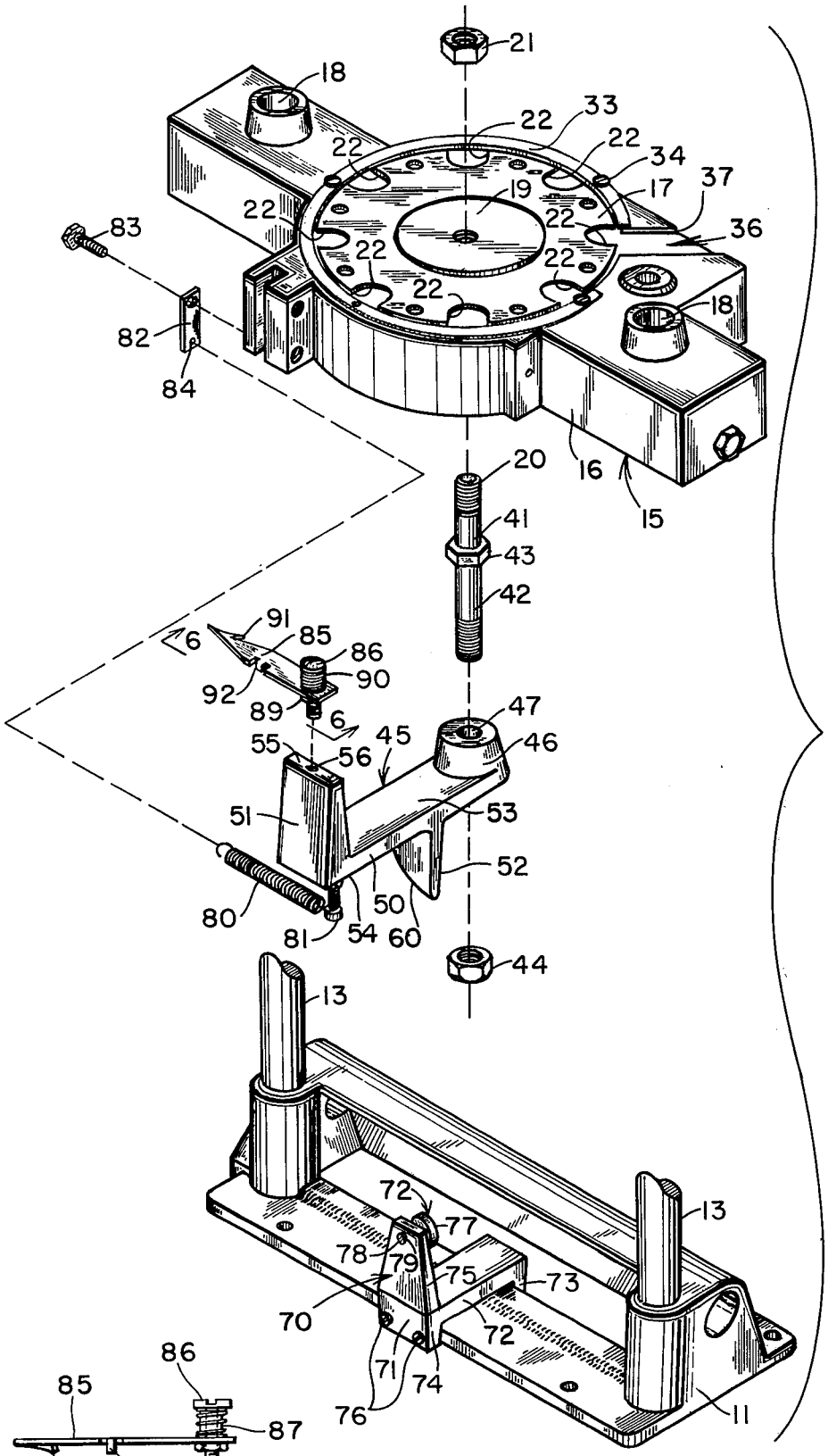
FIG. 5 is an exploded perspective view of several of the components of the reloader; and, FIG. 6 is a side elevational view of a portion of the reloader as seen from a plane indicated by a line 6—6 in FIG. 5.

Referring to FIGS. 4 and 5, the threaded fastener 20 is provided with upper and lower end regions 41, 42 and a centrally located hex head 43. The upper end region 41 extends through aligned holes in the carriage mounting member 16, the support disc 17, and the washer 19, and is threaded to receive the nut 21. The lower end region 42 is threaded to receive a nut 44.

An arm 45 is rotatably supported on the lower end region 42 of the threaded fastener 20. The arm 45 has an enlarged end region 46 which is pivoted with a hole 47. The lower end region 42 extends through the hole 47. The nut 44 is a locking nut which is threaded onto the lower end region 42 to a position which will let the arm 45 rotate freely about the axis of the fastener 20 with minimal play.

The arm 45 has a horizontal stem portion 50, an upstanding end portion 51, and a depending cam portion 52. The stem portion 50 has top and bottom surfaces 53, 54 and extends radially away from the axis of the hole 47 and beyond the back side of the mounting member 16. The upstanding end portion 51 extends upwardly alongside the mounting member 16 and has a top surface 55 which is aligned with the top of the mounting member 16. A threaded hole 56 is formed in the end portion 51 and opens through the top surface 55. A threaded hole 57 opens through the bottom surface 54 of the stem portion 50 and extends upwardly into the end portion 51.

The depending cam portion 52 is curvilinear as viewed from above, as is best seen in FIG. 3. The inner and outer radii of curvature of the cam portion 52 have centers coincident with the axis of the hole 47. A cam surface 60 is formed on he bottom of the cam portion 52.

A cam follower assembly 70 is mounted on the base structure 11. The cam follower assembly 70 includes a bracket 71 and a ball bearing cam follower 72. The bracket 71 has a central portion 72 which extends between and connects a pair of depending leg portions 73, 74, and an upstanding leg portion 75. The central and depending leg portions 72, 73, 74 straddle a portion of the base structure 11. A pair of set screws 76 are threaded through spaced holes formed in the depending leg 74 and clamp the bracket 71 securely in place on the base structure 11.

The cam follower 72 is of a commercially available type and includes a ball bearing 77 journaled on a threaded fastener 78. The fastener 78 is threaded through a hole 79 formed in the upstanding leg 75.

The arm 45 and the cam follower bracket 71 are configured such that the cam surface 60 is aligned with the periphery of the cam follower bearing 77. When the carriage assembly 15 is fully lowered, as in FIG. 1, the cam follower assembly 70 causes arm 45 to rotate to the position shown in phantom in FIG. 3. When the carriage assembly 15 is raised toward the tools 14, the arm 45 is free to rotate between the positions shown in solid lines and in phantom in FIG. 3.

A tension coil spring 80 is provided to bias the arm 45 toward a position where the cam surface 60 will engage the cam follower bearing 77. A threaded fastener 81 is threaded into the arm hole 57. One end of the spring 80 is reeved around and connects with the fastener 81. A mounting plate 82 is secured to the carriage mounting member 16 by a threaded fastener 83. The opposite end of the spring 80 is reeved through a hole 84 formed in the mounting plate 82. The spring 80 biases the arm 45 clockwise (as viewed in FIG. 3) toward the solid line position shown in FIG. 3.

Figure 6:
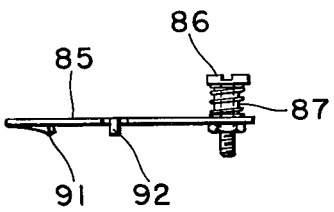

A ratchet pawl 85 is carried by the arm 45 for engaging and intermittently rotating the support disc 17 in response to pivotal movement of the arm 45. Referring to FIG. 4, a threaded fastener 86 pivotally mounts the ratchet pawl 85 on the upstanding portion 51 of the arm 45. Referring to FIGS. 4, 6, a bushing 87 is carried on the fastener 86 and extends loosely through a hole in the pawl 85. The lower end of the fastener 86 is threaded into the threaded hole 56. A lock nut 89 is threaded onto the fastener 86 and is tightened into engagement with the bottom of the bushing 87. A compression coil spring 90 is positioned on the bushing 87 between the head of the fastener 86 and the pawl 85. The spring 90 biases the pawl 85 toward engagement with the lock nut 89 while permitting the pawl to pivot about the bushing 87 freely in horizontal directions and to a limited degree in vertical directions.

The lock nut 89 has about the same thickness as the ring segment 33 and, as is best seen in FIG. 4, positions the pawl 85 in a horizontal plane overlying the ring segment 33. A depending tab 92 is formed on the pawl 85. The tab 92 is engageable with the outer surface of the ring segment 33 and limits clockwise pivotal movement of the pawl 85 (as viewed in FIG. 3).

A toothed formation 91 is provided on the ratchet pawl 85 to drivingly engage the support disc notches 22. As is best seen in FIG. 6, the toothed formation 91 is curved downwardly and defines a pointed tooth which depends inside the ring segment 33. The pawl 85 is configured such that when the arm 45 pivots clockwise (as viewed in FIG. 3) the tooth formation 91 enters the space 35 and travels around the periphery of the support disc 17 whereby the pawl 85 is prevented from drivingly engaging the shot shell support disc 17. When the tooth formation 91 enters the space 35, the tooth formation 91 rides upwardly on the ring segment 33 causing the toothed end of the pawl 85 to pivot slightly upwardly and outwardly in opposition to the action of the spring 90. When the arm 45 reaches the position shown in solid lines in FIG. 3, the pawl tooth formation 91 drops into one of the support disc notches 22. When the arm 45 is subsequently pivoted counterclockwise to the position shown in phantom in FIG. 3, the pawl 85 causes the support disc 17 to rotate counterclockwise.

The operation of the described apparatus is best understood by starting with the carriage assembly 15 in its fully lowered position shown in FIG. 1. When the carriage assembly 15 is fully lowered, the arm 45 assumes the position shown in phantom in FIG. 3.

As the handle 28 is pivoted forwardly and downwardly to raise the carriage assembly 15, the tension coil spring 80 causes the arm 45 to pivot clockwise to the position shown in solid lines in FIG. 3 where the pawl tooth 91 engages one of the notches 22. As the handle 28 is pivoted upwardly and rearwardly to lower the carriage assembly at the completion of a reloading step or operation, the cam surface 60 rides along the peripghery of the cam follower bearing 77 and causes the arm 45 to pivot counterclockwise to the position shown in phantom in FIG. 3. As the cam 45 pivots counterclockwise, the pawl 85 rotates the support disc 17 to reposition such shot shells as are received in the notches 22 in a subsequent operating station. The apparatus 10 is then ready for a subsequent reloading step or operation which is effected by repeating the described handle movements.

Although the invention has been described in its preferred form with a certain degree of particularity, it is understood that the present disclosure of the preferred form has been made only by way of example and numerous changes in the details of construction and the combination and arrangement of parts may be resorted to without departing from the spirit and the scope of the invention as hereinafter claimed.

What is claimed is:

1. In a shot shell reloader of the type including a base structure, an elevatable carriage supported on the base structure, a positioning mechanism for raising and lowering the carriage relative to the base structure, a plurality of tools supported above the carriage and defining a plurality of operating stations spaced circumferentially about an imaginary circle having a substantially vertical axis, a shotshell support supported by the carriage for rotation about such axis, and a plurality of spaced formations on each support, each of such formations being adapted to receive a separate shot shell and to position such received shot shells simultaneously in different ones of the operating stations, the improvement of a drive mechanism engageable with the shotshell support for rotating the shotshell support to position shot shells received in such support formations sequentially in each of the operating stations, comprising:

a. first cam means including a curvilinear cam surface;
b. second cam means including a cam follower for engaging said cam surface;
c. an arm supported on the elevatable carriage and being pivotally movable about such axis between first and second positions;
d. one of said cam means being supported on said arm, and the other of said cam means being supported on the base structure;
e. biasing means operably connected to said arm to bias said cam follower and said cam surface relatively toward engagement with each other;
f. said first and second cam means and said biasing means being operable, in response to raising of the carriage by the positioning mechanism to pivot said arm in a forward direction about such axis from said first position to said second position, and in response to lowering of the carriage by the positioning mechanism to pivot said arm in a reverse direction about such axis from said second position to said first position; and
g. pawl means carried by said arm for drivingly engaging the rotatable shotshell support when said arm is pivoted in a selected one of said forward and reverse directions to rotate such support and to move such received shot shells between adjacent operating stations.

2. The apparatus of claim 1 wherein said pawl means sequentially drivingly engages each of the shot shell receiving formations in such support in moving such received shot shells sequentially to each of the operating stations.

3. The apparatus of claim 1 wherein said pawl means is operable to establish driving engagement with the rotatable shot shell support when said arm is pivoted in said reverse direction.

4. In a shot shell reloader of the type including a base structure, an elevatable carriage supported on the base structure, a positioning mechanism for raising and lowering the carriage relative to the base structure, a plurality of tools supported above the carriage and defining a plurality of operating stations spaced circumferentially about an imaginary circle having a substantially vertical axis, a shotshell support supported by the carriage for rotation about such axis, and a plurality of spaced formations on such support, each of such formations being adapted to receive a separate shot shell and to position such received shot shells simultaneously in different ones of the operating stations, the improvement of a drive mechanism engageable with the shotshell support for rotating the shotshell support to position shot shells received in such support formations sequentially in each of the operating stations, comprising:

a. an arm supported on the elevatable carriage and being pivotally movable about such axis between first and second positions;
b. a curvilinear cam surface defined on said arm;
c. a cam follower supported on the base structure and positioned to engage said cam surface;
d. biasing means biasing said arm toward said second position;
e. said cam surface and said cam follower being operable to pivot said arm in position to said biasing means toward said first position as the carriage is lowered by the positioning mechanism;
f. said biasing means being operable to pivot said arm toward said second position as the carriage is raised by the positioning mechanism, and
g. pawl means carried by said arm for drivingly engaging the rotatable shotshell support when said arm is pivoted by said cam surface and said cam means toward said first position to rotate such support and to move such received shot shells between adjacent operating stations.

5. The apparatus of claim 4 wherein said pawl means sequentially drivingly engages each of the shot shell receiving formations in such support in moving such received shot shells sequentially to each of the operating stations.

6. The apparatus of claim 4 additionally including second biasing means biasing said pawl means into engagement with the rotatable shot shell support.

7. The apparatus of claim 4 wherein said cam surface is defined on the bottom of a depending projection formed integrally with said arm.

8. Apparatus for converting a shot shell reloader having a manually rotatable shotshell support to a reloader having an automatically rotating shotshell support, and wherein the reloader includes a base structure, an elevatable carriage, a positioning mechanism for raising and lowering the carriage relative to the base structure, a plurality of tools supported above the carriage and defining a plurality of operating stations spaced circumferentially about an imaginary circle having a substantially vertical axis, the shotshell support being rotatably supported on the carriage for rotation about such axis and having a plurality of spaced inwardly extending notches each being adapted to receive a separate shot shell and to position such received shot shells simultaneously in different ones of the operating stations, the conversion apparatus comprising:

a. arm means adapted to be pivotally supported on the carriage for pivotal movement about such axis between first and second positions;

b. a curvilinear cam surface defined on said arm means;

c. cam follower means defining a cam follower surface and being adapted to be supported on the base structure in a position where said cam follower surface can engage said cam surface;

d. biasing means connected to said arm means and adapted for connection to the elevatable carriage to bias said arm means toward said second position;

e. said cam surface and said cam follower surface being operable once said arm means and said cam follower means are supported on the carriage and the base structure, respectively, to pivot said arm means in opposition to said biasing means toward said first position as the carriage is lowered by the positioning mechanism;

f. said biasing means being operable once said arm means and said biasing means have been connected to the elevatable carriage to pivot said arm means toward said second position as the carriage is raised by the positioning mechanism; and g. pawl means carried by said arm means for drivingly engaging the notches in the rotatable shotshell support when said arm means is pivoted by said cam surface and said cam follower surface toward said first position to rotate said support and to move such received shot shells between adjacent operating stations.

9. The apparatus of claim 8 wherein said pawl means is operable to sequentially drivingly engage each of the shot shell receiving formations in such support in moving such received shot shells sequentially to each of the operating stations.

10. The apparatus of claim 8 additionally including second biasing means biasing said pawl means into engagement with the rotatable shot shell support.

* * * * *